United States Patent [19]

Stayton et al.

[11] 4,041,871

[45] Aug. 16, 1977

[54] SHOCK BUFFER FOR LIQUID PROPELLANT GUN PROJECTILE

[75] Inventors: Leroy M. Stayton; Robert A. Gould, both of Ridgecrest, Calif.

[73] Assignee: The United States of America as represented by the Secretary of the Navy, Washington, D.C.

[21] Appl. No.: 705,733

[22] Filed: July 15, 1976

[51] Int. Cl.[2] ..... F42B 13/00; F42B 7/08

[52] U.S. Cl. ..... 102/95; 102/92.2

[58] Field of Search ..... 102/95, 92.1–92.4, 102/93, 105; 89/7

[56] References Cited

U.S. PATENT DOCUMENTS

| | | | |
|---|---|---|---|
| 654,107 | 7/1900 | Ashton | 102/93 |
| 2,559,275 | 7/1951 | Brown et al. | 102/95 |
| 3,053,185 | 9/1962 | Oberfell et al. | 102/95 |

*Primary Examiner*—Charles T. Jordan

*Attorney, Agent, or Firm*—R. S. Sciascia; Roy Miller; Lloyd E. K. Pohl

[57] ABSTRACT

A projectile for a liquid propellant gun comprising a metallic forward end and a shock buffer aft end made up of from about 60 to about 40 volume percent microballoons and from about 40 to about 60 volume percent binder.

6 Claims, 1 Drawing Figure

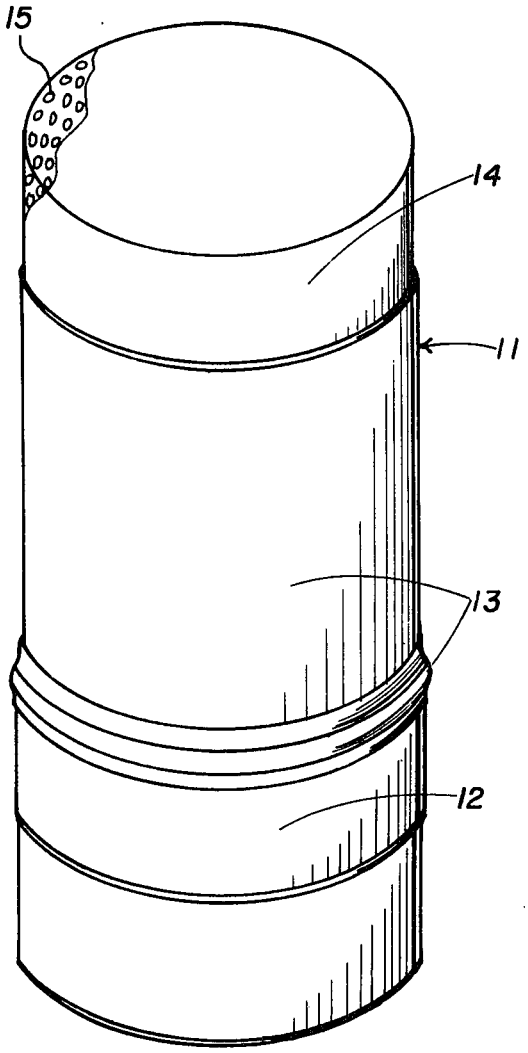
15
14
11
13
12

SHOCK BUFFER FOR LIQUID PROPELLANT GUN PROJECTILE

BACKGROUND OF THE INVENTION

1. Field of the Invention.

This invention relates to projectiles for liquid propellant guns. More particularly, this invention relates to projectiles containing shock buffers.

2. Description of the prior art.

Experimentation is presently being carried out in efforts to develop a liquid propellant gun suitable for military use. A liquid propellant gun is one in which gases produced by ignited propellant are used to drive a projectile from the barrel. The use of a liquid propellant in lieu of the conventional material, gun powder, offers many potential advantages among which is the advantage of eliminating the need for cartridge cases.

A liquid propellant gun contains, among other parts, a barrel and a firing chamber. During the loading cycle, a projectile is, at one point in time, at the rear of the firing chamber. At this point in time, liquid propellant is injected behind the projectile and a bolt is used to force the liquid and the projectile in front of it forward until the projectile seats in the rear of the barrel and the liquid fills the firing chamber behind the projectile. At this point in time, i.e., when the projectile is seated in the rear of the barrel and the liquid fills the firing chamber, the rear of the firing chamber is closed by the bolt. The gun is now ready for firing. To fire, a spark mechanism in the firing chamber is activated. The spark ignites the liquid propellant and hot expanding gases produced by the propellant drive the projectile out through the barrel.

In the past, the projectile has typically been a solid metallic projectile. It has typically, although not necessarily, been coated, on its rear portions, with a thin layer of Viton A or the like. The thin coating of Viton A or the like has been utilized to prevent liquid propellant from flowing forward, around the periphery of the projectile, into the gun barrel as the projectile seats in the rear of the barrel.

When the propellant in a liquid propellant gun is ignited, tremendous pressure rises occur in the firing chamber. A shock wave travels through the liquid, strikes the base of the projectile and is reflected back. This reflected wave amplifies, up to 90%, the normal pressure in the firing chamber and sometimes causes expansion and damage to the firing chamber. Pressures of up to 150,000 psi have been measured in the firing chamber.

Because of these tremendous pressures, the chamber has previously been required to be very thick-walled. The wall of the cylindrical chamber in a typical gun has been on the order of 1¼ inches thick and the chambers have typically been made of high strength stainless steel. Because of this required thickness of the chamber wall, the firing chamber has naturally been a very heavy part of the gun. Because weight considerations are of great importance when any article is to be incorporated as part of an aircraft, it would be desirable to be able to reduce the thickness of the wall of the firing chamber and thus make the part lighter.

SUMMARY OF THE INVENTION

According to this invention, a liquid propellant gun projectile is provided with a shock buffer. The shock buffer is attached to the base of the projectile. The shock buffer greatly decreases the effects of pressure within the firing chamber of the gun and permits the use of a much thinner-walled firing chamber than was heretofor possible. The shock buffer of this invention is preferably made up of from 60 to 40 volume percent microballoons and from 40 to 60 volume percent of a binder resin.

BRIEF DESCRIPTION OF THE DRAWING

The single FIGURE is a perspective view of a projectile for a liquid propellant gun which is provided with a shock buffer according to this invention.

DESCRIPTION OF THE PREFERRED EMBODIMENT

Going first to the drawing, a typical projectile 11 is bare metal at its forward end 12 and is coated with a thin layer 13 of Viton A or the like, for the reason recited above, on its rear portions. According to this invention, a shock buffer 14 is provided on the aft end of the projectile. In tests, the shock buffer 14 has been made up of from 60 to 40 volume percent phenolic microballons and from 40 to 60 volume percent of a resinous binder. If more than 60 volume percent microballoons were used, it was found to be difficult to properly wet the microballoons with resin and, therefore, difficult to bind them. If less than about 40 volume percent microballoons were used, the shock buffer did not properly do its job of buffering. Microballoons are indicated in the drawing by the numeral 15.

The microballoons used in tests have been commercially available phenolic microballoons. However, microballoons made of other materials may also be used. In test conducted, microballoons having a nominal diameter of about 15 microns with diameters ranging from a low of about 3 microns up to a high of about 30 microns have been used.

Almost any binder may be used. Epoxy cured with polyamide resins was used in tests. However, polyurethane resins, polyester resins, polytetrafluoroethylene (Teflon) and Viton A (a copolymer of vinylidene fluoride and hexafluoro-propylene) are other examples of suitable resins.

The shock buffer may be fabricated in place by placing the projectile base end up, arranging a mold around its base prevent the material from flowing off, pouring a mixture of the uncured resin and microballoons into place, allowing the resin to cure and then removing the mold. In the alternative, discs of resin and microballoons may be prepared and fastened to the base of the projectile by means of an adhesive. Injection molding techniques may also be used.

When projectiles which do not contain the shock buffer of this invention are fired from liquid propellant guns, it has been found that the pressure on the rear of the projectile typically flashes upward to from 95,000 to 150,000 psi, drops sharply to from zero to about 15,000 psi, then raises sharply to about 80,000 psi or more and then drops sharply to on the order of 20,000 psi all in a time period of less than about 0.5 millisecond. When a shock buffer according to this invention having a thickness in the range of from about ½ inches to about ¼ inches, made up of about 50 volume percent microballoons and 50 volume percent phenolic resin is used, the peak pressures are reduced on the order of 20%. This permits the use of a thinner-walled firing chamber than was previously possible.

In tests, as pointed out above, microballoons having a nominal diameter of 15 microns were used. As also pointed out, a 60 to 40 volume percent of binder was used. It may be found, in later experiments, that a different nominal diameter for the microballoons may permit the use of less binder.

What is claimed is:

1. A projectile for a liquid propellant gun comprising a metallic forward end and an aft end which is a shock buffer made up of microballoons bound in a binder resin.

2. A projectile according to claim 1 wherein the microballoons make up from 60 to 40 volume percent of said buffer.

3. A projectile according to claim 2 wherein the resin is selected from the group consisting of epoxy resins, polyurethane resins, polyester resins, polytetrafluoroethylene and a copolymer of vinylidene flouride and hexafluoropropylene.

4. A projectile according to claim 3 wherein the microballoons are phenolic microballoons and the resin is epoxy resin.

5. A projectile according to claim 4 wherein the shock buffer contains about 50 volume percent microballoons and 50 volume percent resin and is in the shape of a disk.

6. A projectile according to claim 5 wherein the microballoons have a nominal diameter of 15 microns.

* * * * *